US005355417A

United States Patent [19]

Burdisso et al.

[11] Patent Number: 5,355,417

[45] Date of Patent: Oct. 11, 1994

[54] ACTIVE CONTROL OF AIRCRAFT ENGINE INLET NOISE USING COMPACT SOUND SOURCES AND DISTRIBUTED ERROR SENSORS

[75] Inventors: Ricardo Burdisso; Chris R. Fuller; Walter F. O'Brien; Russell H. Thomas, all of Blacksburg, Va.; Mary E. Dungan, Malden, S.C.

[73] Assignees: The Center for Innovative Technology, Herndon; Virginia Polytechnic Institute & State University; Virginia Tech Intellectual Properties, Inc., both of Blacksburg, all of Va.

[21] Appl. No.: 964,604

[22] Filed: Oct. 21, 1992

[51] Int. Cl.[5] ..... G10K 11/16

[52] U.S. Cl. ..... 351/71; 381/190

[58] Field of Search ..... 381/57, 107, 108, 71, 381/190

[56] References Cited

U.S. PATENT DOCUMENTS

| | | | |
|---|---|---|---|
| 2,043,416 | 6/1936 | Leug . | |
| 4,044,203 | 8/1977 | Swinbanks | 381/71 |
| 4,715,559 | 12/1987 | Fuller | 381/71 |
| 4,947,434 | 8/1990 | Ito | 381/71 |
| 5,091,953 | 2/1992 | Tretter | 381/71 |

FOREIGN PATENT DOCUMENTS

| | | | |
|---|---|---|---|
| 58-39200 | 3/1983 | Japan | 381/190 |
| 2205948 | 12/1988 | United Kingdom | 381/190 |

*Primary Examiner*—Forester W. Isen

*Attorney, Agent, or Firm*—Whitham, Curtis, Whitham and McGinn

[57] ABSTRACT

An active noise control system using a compact sound source is effective to reduce aircraft engine duct noise. The fan noise from a turbofan engine is controlled using an adaptive filtered-x LMS algorithm. Single multi channel control systems are used to control the fan blade passage frequency (BPF) tone and the BPF tone and the first harmonic of the BPF tone for a plane wave excitation. A multi channel control system is used to control any spinning mode. The multi channel control system to control both fan tones and a high pressure compressor BPF tone simultaneously. In order to make active control of turbofan inlet noise a viable technology, a compact sound source is employed to generate the control field. This control field sound source consists of an array of identical thin, cylindrically curved panels with an inner radius of curvature corresponding to that of the engine inlet. These panels are flush mounted inside the inlet duct and sealed on all edges to prevent leakage around the panel and to minimize the aerodynamic losses created by the addition of the panels. Each panel is driven by one or more piezoelectric force transducers mounted on the surface of the panel. The response of the panel to excitation is maximized when it is driven at its resonance; therefore, the panel is designed such that its fundamental frequency is near the tone to be canceled, typically 2000–4000 Hz.

14 Claims, 18 Drawing Sheets

ACTIVE CONTROL OF AIRCRAFT ENGINE INLET NOISE USING COMPACT SOUND SOURCES AND DISTRIBUTED ERROR SENSORS

This invention was made with government support under contract number NASI-18471, awarded by NASA. The government has certain rights in this invention.

BACKGROUND OF THE INVENTION

1. Field of the Invention

The present invention generally relates to an active noise control scheme for reducing aircraft engine noise and, more particularly, to a noise control system incorporating compact sound sources and distributed inlet error sensors for reducing the noise which emanates from an aircraft engine inlet of a gas turbine engine.

2. Description of the Prior Art

Noise has been a significant negative factor associated with the commercial airline industry since the introduction of the aircraft gas turbine engine. Considerable effort has been directed toward quieting aircraft engines. Much of the progress to date is associated with the development of the high bypass ratio turbofan engine. Because the jet velocity in a high bypass engine is much lower than in low or zero bypass engines, the exhaust noise associated with this engine is greatly reduced. Although exhaust noise in high bypass engines has been greatly reduced, fan and compressor noise radiating from the engine inlet remains a problem. In fact, as turbine engines evolved from turbojet to primarily turbofan engines, fan noise has become an increasingly large contributor of total engine noise. For high bypass ratio engines (i.e. , bypass ratios of 5 or 6) currently in use, fan noise dominates the total noise on approach and on takeoff. More specifically, the fan inlet noise dominates on approach, and the fan exhaust noise on takeoff. However, acoustic wall treatment has only made small reductions in fan inlet noise levels of less than 5 dB. This is compounded by inlet length-to-radius ratio becoming smaller. A typical fan acoustic spectrum includes a broadband noise level and tones at the blade passage frequency and its harmonics. These tones are usually 10 to 15 dB above the broadband level. This is for the case where the fan tip speed is subsonic. Multiple pure tones appear as the tip speed becomes supersonic.

Not only is fan noise a problem in existing aircraft engines, it has been identified as a major technical concern in the development of the next-generation engines. Rising fuel costs have created interest in more fuel-efficient aircraft engines. Two such engines currently in development are the advanced turbo-prop (ATP) and the ultra-high-bypass (UHB) engines. Although attractive from the standpoint of fuel efficiency, a major drawback of these engines is the high noise levels associated with them. Not only will the introduction of ultra high bypass ratio engines in the future, with the bypass ratios in the range of 10, result in a greater fan noise component, with shorter inlet ducts relative to the size of the fan and for the lower blade passage frequencies expected for these engines, passive acoustic liners will have greater difficulty contributing to fan noise attenuation because liners are less effective as the frequencies decrease and the acoustic wavelength increases. Because of these difficulties, it is likely that passive fan noise control techniques, while continuing to progress, will be combined with active noise control techniques to produce a total noise control solution for fans.

For subsonic tip speed fans, noise is produced by the interaction of the unsteady flows and solid surfaces. This could be inflow disturbances and the inlet boundary layer interacting with the rotor or the rotor wakes interacting with the stator vanes. Acoustic mode coupling and propagation in the duct and, in turn, acoustic coupling to the far field determines the net far field acoustic directivity pattern.

Reduction of noise from the fan of a turbomachine can be achieved by reduction of the production processes at the source of the noise or by attenuation of the noise once it has been produced. Source reduction centers on reduction of the incident aerodynamic unsteadiness or the resulting blade response and unsteady lift or the mode generation and propagation from such interactions.

Most efforts at noise reduction in this area are passive in nature in that the reduction method is fixed. Examples include the effects of respacing the rotor and stator or the spacing of the rotor and downstream struts. However, there have been some efforts at active control of these source mechanisms. Preliminary experiments have shown the attenuation of noise from an incident gust on an airfoil by actuating a trailing edge flap to control the unsteady lift. In general, an attempt to alter source mechanisms will require engine redesign and the effect on performance will have to be assessed.

Efforts to date at reductions in source noise have been insufficient in reducing overall engine noise levels to the required levels. The additional reductions have been met with passive engine duct liners. The contribution of duct liners is primarily in attenuating fan exhaust noise where the propagating modes have a higher order and propagate away from the engine axis where liners can be most effective. In the fan inlet, the modes are propagating against the boundary layer and are refracted toward the engine axis, minimizing the effectiveness of liners.

Another option for turbofan noise reduction is to actively control the disturbance noise with a second control noise field. The concept of active sound control, or anti-noise as it is sometimes referred to, is attributed to Paul Leug. See U.S. Pat. No. 2,043,416 to Leug for "Process for Silencing Sound Oscillations". The principle behind active control of noise is the use of a second control noise field, created with multiple sources, to destructively interfere with the disturbance noise. A further distinction can be made if the control is adaptive; that is, it can maintain control by self-adapting to an unsteady disturbance or changes in the system.

While Leug's patent is almost sixty years old, only in the past ten to twenty years has active control begun to converge in many applications. The applications of active control were made possible by the advancements in digital signal processing and in the development of adaptive control algorithms such as the very popular least-mean-square (LMS) algorithm.

SUMMARY OF THE INVENTION

It is therefore an object of the present invention to provide an active noise control system for the effective control of aircraft engine inlet noise.

It is another object of the invention to provide a compact sound source suitable for use in an active noise control mechanism which is applicable for an operational aircraft engine.

According to the present invention, an effective active noise control system is applied to reduce the noise emanating from the inlet of an operational turbofan engine. In a specific application, the fan noise from a turbofan engine is controlled using an adaptive filtered-x LMS algorithm. Single and multi channel control systems are used to control the fan blade passage frequency (BPF) tone and the BPF tone and the first harmonic of the BPF tone for a plane wave excitation. A multi channel control system is used to control any spinning mode or combination of spinning modes. The preferred embodiment of the invention uses a multi channel control system to control both fan tones and a high pressure compressor BPF tone simultaneously.

In order to make active control of turbofan inlet noise a viable technology, it is necessary to provide a suitable sound source to generate the control field. In a specific implementation of the invention, the control field sound source consists of an array of thin, cylindrically curved panels with inner radii of curvature corresponding to that of the engine inlet so as to conform to the inlet shape. These panels are flush mounted inside the inlet duct and sealed on all edges to prevent leakage around the panel and to minimize the aerodynamic losses created by the addition of the panels. Each panel is driven by one or more induced strain actuators, such as piezoelectric force transducers, mounted on the external surface of the panel. The response of the panel, driven by an oscillatory voltage, is maximized when it is driven at its resonance frequency. The panel response is adaptively tuned such that its fundamental frequency is near the tone to be canceled. The controller requires information of the resulting sound field radiated by the engine and control sources. This error information allows the controller to generate the proper signals to the control sources. The radiated sound information is obtained by an array of distributed sensors installed in the engine inlet, fuselage or wing, as may be appropriate to a particular aircraft design.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Experimental work by the inventors has demonstrated the applicability of active control technology to aircraft engine duct noise. In these experiments, a research rig built around a Pratt and Whitney JT15D turbofan engine was fitted with an array of horn drivers located around the inlet circumference a short distance upstream of the fan. This array of loudspeakers served as a secondary source while the primary source was the fundamental blade passage tone and harmonics of the fan, generated by the fan's interaction with stationary upstream rods. Under near idle operating conditions, a significant decrease in overall sound field was realized when control was actuated.

Experimental Method

The approach is to experimentally implement an adaptive feed forward active noise control system on an operational turbofan engine. The system reduces the level of tones produced by the engine by the destructive interference of control noise sources and the disturbance tones to be reduced. The active control system has four main components. A reference sensor generates a signal providing information on the frequency of the disturbance tone. This signal is fed forward to the adaptive filters and the outputs signals from the filters to the control sources. Error sensors are placed in the far field of the engine to measure the resultant noise. In a practical implementation, the error sensors are replaced by distributed sensors inside the inlet or on the fuselage or wing of the aircraft. The control algorithm takes input from the reference and error sensors and adjusts the adaptive filters to minimize the signal from the error sensors. The control sound sources are compression drivers mounted on the inlet of the engine. These control sources in a practical embodiment are replaced by tunable curved panels, described in more detail hereinafter. A schematic of the engine, test cell, and the components of the controller are shown in FIG. 1 and will be discussed in the next three sections.

ENGINE AND TEST CELL

Figure 1:
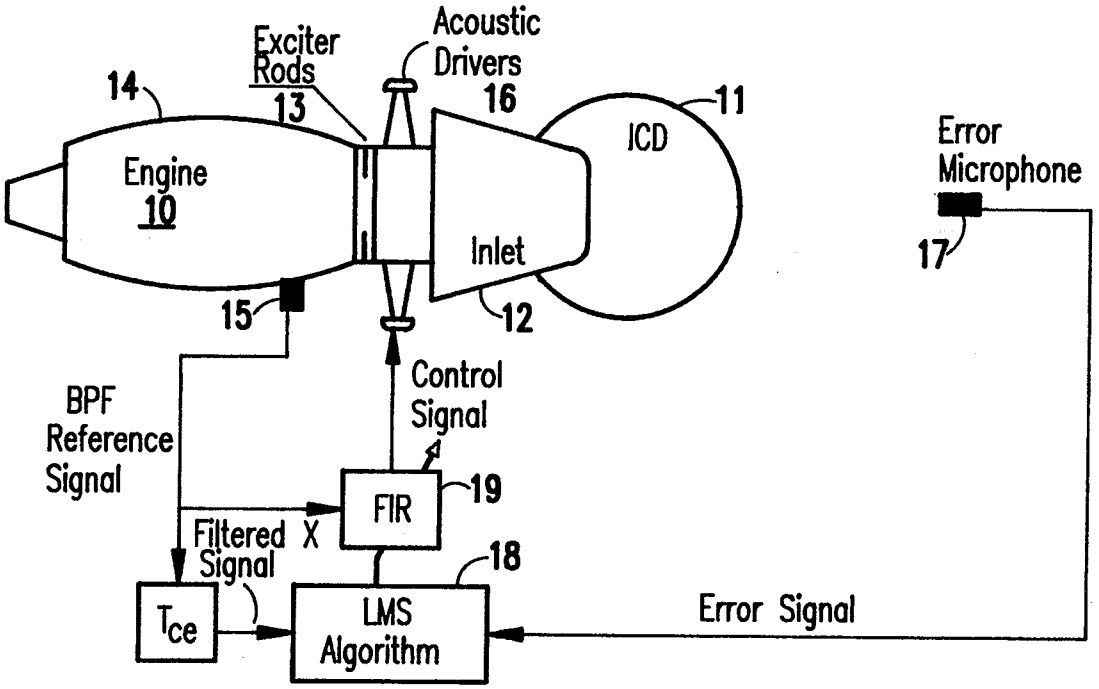
FIG. 1 is a block diagram of a turbofan engine in a test cell with active control system components using a single channel control system.

With specific reference to FIG. 1, a Pratt and Whitney of Canada JT15D-I turbofan engine 10 is mounted in a test cell configuration. The JT15D engine is sized for an executive jet class of aircraft. It is a twin spool turbofan engine with a full length bypass duct and a maximum bypass ratio of 2.7. There is a single stage axial flow fan with twenty-eight blades and a centrifugal high pressure compressor with sixteen fill vanes and sixteen splitter vanes. There are no inlet guide vanes and the diameter at the fan stage location is 0.53 m(D). The maximum rotational speed of the low pressure spool is 16,000 rpm and 32,760 rpm for the high pressure spool. The fan has a pressure ratio of 1.2 and a hub-to-tip ration of 0.41. The low pressure stator assembly following the fan consists of an outer stator in the bypass duct which has sixty-six stators. The number of stators and the position of the core stator is the only alteration from the production version. The core stator has seventy-one vanes replacing the thirty-three vanes of the production engine. Also, in this research engine the core stator is repositioned downstream to a distance of 0.63 fan-blade-root-chords from the fan blade root as compared to 0.28 chords for the production version.

The engine 10 is equipped with an inflow control device (ICD) 11 mounted on the inlet 12. The purpose of the ICD 11 is to minimize the spurious effects of ground testing on acoustic measurements. Atmospheric turbulence and the ground vortex associated with testing an engine statically on the ground are stretched by the contraction of flow into the engine and this generates strong tone noise by the fan which is unsteady and not present in flight. The ICD 11 is a honeycomb structure which breaks up incoming vortices. The honeycomb is two inches thick and the cells are aligned with streamlines calculated from a potential flow analysis. The ICD 11 is constructed to produce a minimum pressure drop and negligible acoustic transmission losses. There is also no redirection of acoustic directivity and no new acoustic sources are erected. This ICD 11 was also designed to be more compact than inflow control devises available at that time. The maximum diameter is equivalent to 2.1 engine inlet diameters (D). An ICD of this type is particularly important when an engine is mounted very close to the ground as in this ease, 1.3D.

The engine 10 is mounted in a test cell which is divided by a wall (not shown) so that the forward section of the test cell is a semi-anechoic chamber where only the inlet 12 of the engine 10 is inside the chamber. The walls of the semi-anechoic chamber are covered with three inch think acoustic foam which minimizes reverberations and minimizes the influence of the noise from the jet of the engine. One wall of the semi-anechoic chamber is open to the atmosphere for engine intake air.

ACTIVE CONTROL APPARATUS

The JT15D engine is a much quieter engine than most high bypass engines. Thus, to demonstrate the performance of the control system, an array of disturbance rods were installed in the engine to generate noise similar to the noise found in ultra high bypass engines. These rods are the exciter rods 13, equally spaced circumferentially, placed 0.19D upstream of the fan stage 14. Twenty-eight rods were used to excite disymmetric acoustic modes, while twenty-seven rods were used to excite spinning modes. The rods 13 extend 27% of the length of the fan blades through the outer casing into the flow. The wakes from the rods interact with the fan blades producing tones which are significantly higher in sound level than without the interactions. The purpose of the reds 13 is to excite to dominance an acoustic mode. The JT15D engine is much quieter than most high bypass engines, and the rods 13 serve in this test to generate noise similar to other high bypass engines. With twenty-eight reds, a number equal to the twenty-eight fan blades, a plane wave mode is excited to dominance. The plane wave mode has a uniform pressure amplitude over the inlet cross-section and is highly propagating, beaming along the engine axis.

Figure 2:
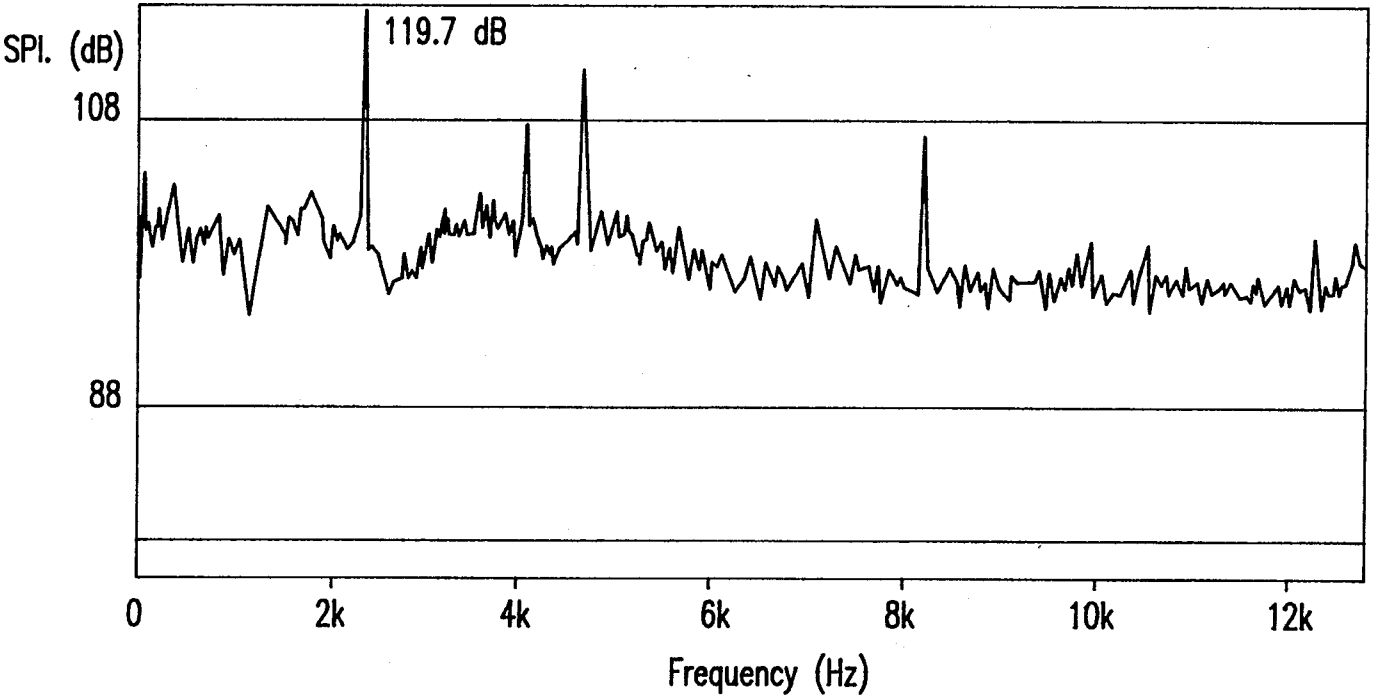
FIG. 2 is a graph showing the unfiltered spectrum of the turbofan engine noise measured on the engine axis at a distance of 3.0D.

A spectrum of the uncontrolled engine noise taken on the axis is shown in FIG. 2. It is marked by three significant tones, the fan blade passage frequency (FBPF) tone at about 2360 Hz and its first harmonic (2FBPF) at about 4720 Hz, and the blade passage frequency tone of the high pressure compressor (HPBPF) at about 4100 Hz. These frequencies correspond to the idle operating condition of the engine with the low pressure spool at 31% of full speed and the high pressure spool at 46%. These frequencies are higher than those found on ultra high bypass engines at full speed. The typical frequencies of ultra high bypass engines are closer to 500 Hz.

The engine was run at idle condition for all of the experiments so that these three tones would be in the audible range and, for the frequencies involved, all three tones would be within the computational speed requirements of the controller.

The reference signals which are required by the feed forward controller are produced by sensors mounted on the engine. One sensor 15 is mounted flush with the casing at the fan stage 14 location. This eddy-current sensor picks up the passage of each fan blade and provides a very accurate measure of the blade passage frequency of the fan and generates a signal which is correlated with radiated sound. The signal also contains several harmonics of the FBPF which can be used, with filtering, to provide a reference for the 2FBPF tone. All these signals are correlated with the radiated noise.

The second reference sensor must provide the blade passage frequency of the high pressure compressor. To install an eddy-current sensor, as described above, disassembly of the engine would be required. To avoid this, a sensor was installed on the tachometer shaft (not shown) which is accessible from the accessory gearbox. The tachometer shaft has a geared direct drive from the high pressure spool. The reference sensor consists of a gearbox driving a wheel with ninety-nine holes such that the passage of each hole corresponds to the passage of a blade on the high pressure compressor. An optical sensor produces a signal with each hole passage.

The loudspeakers 16 attached to the circumference of the inlet 12 are the control sound sources. They are actuated by the controller producing control noise which interferes and reduces the engine tonal noise. Two loudspeakers are attached to each horn for a total of twelve horns and twenty-four loudspeakers. The loudspeakers 16 are commercially available 8 ohm drivers capable of 100 watts on continuous program with a flat frequency response to within 2 dB from 2 kHz to 5 kHz. The horns have a throat diameter of 1.9 cm with an exponential flare in the direction of flow in the inlet. The opening of the horn in the inlet wall is 1.9 cm×7.6 cm.

Error sensors are the last component of the active control hardware. These are represented by microphone 17 which measures the resultant noise of the engine and control sound sources. A particular mode of engine noise can be highly directional and unsteady. A conventional 1.25 cm diameter microphone will produce a more unsteady signal than a microphone which is much larger in surface area and spatially averages the incident sound pressure level. Error sensors were made of polyvinyldi-fluoride (PVDF) film 7.6 cm in diameter. The film was flat and backed with foam. These large area PVDF microphones produce a measurement of sound pressure level relative to each other.

The BPF reference signal from sensors 15 and the error signal from microphone 17 are input to a controller 18 which implements a filtered-x least mean square (LMS) algorithm to control an adaptive finite impulse response (FIR) filter 19 for a single channel controller. For multiple channel control, the algorithm will adapt an array of FIR filters. The output of the FIR filter drives the loud speakers 16 to generate a secondary sound field having an approximately equal amplitude but opposite phase as the primary sound field to thereby effectively reduce said engine noise.

ACTIVE CONTROL ALGORITHM

Figure 3:
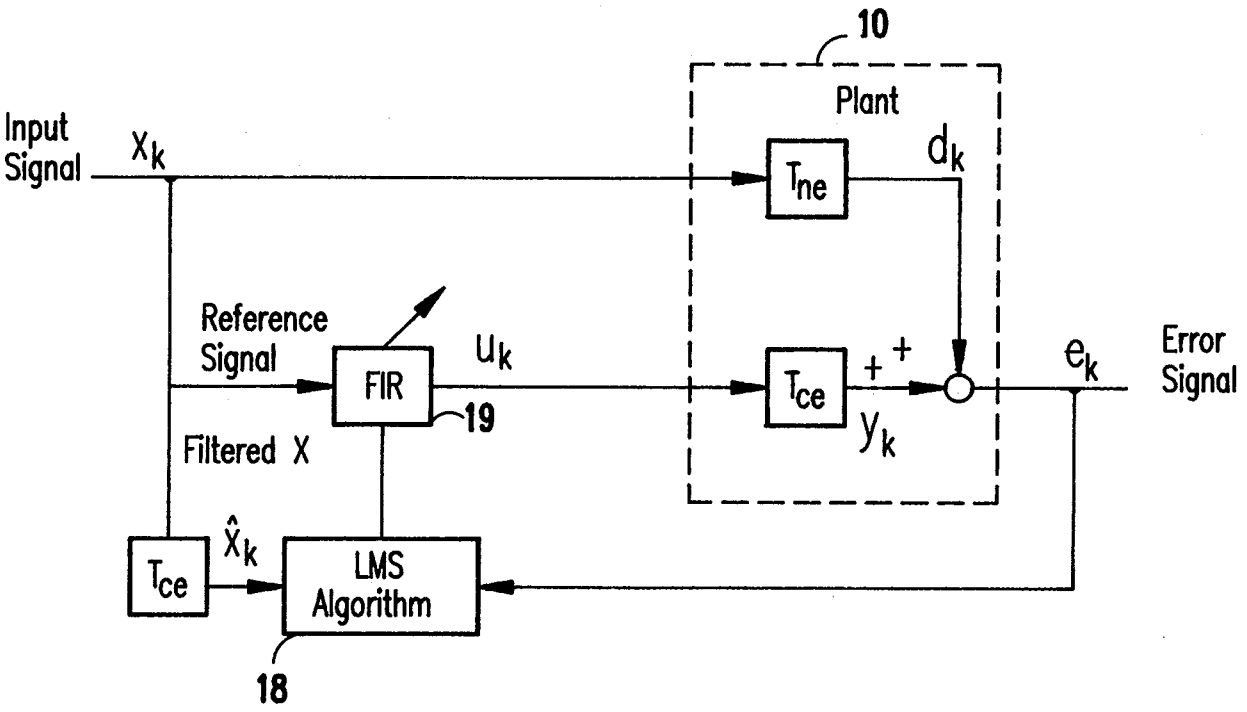
FIG. 3 is a block diagram showing an implementation of the filtered-x LMS algorithm.

For the sake of clarity in this disclosure, a block diagram of a single channel controller implementing a filtered-x LMS control algorithm is shown in FIG. 3. The resultant signal from the plant (i.e., the engine) 10 is the error signal, $e_k$, which is the combination of the disturbance signal, $d_k$, and the signal due to the control source, $Y_k$, $$e_k = d_k + y_k, \tag{1}$$

where the subscript k indicates a signal sample at time $t_k$. The response due to the control sources, $Y_k$, Can be replaced in terms of the input to the control sources, $U_k$, and the transfer function between the control input and its response at the error sensor, $y_k$, as $$e_k = d_k + T_{ce}(k) * u_k, \tag{2}$$

where the * operator denotes convolution. $T_{ce}(k)$ represents a causal, shift-invariant system such that the convolution can be found from the following convolution sum.

$$Tce(k) * u_k = \sum_{n=0}^{\infty} T_{ce}(n)\, u_{k-n} \tag{3}$$

The input to the control sources, $U_k$, is the result of filtering a reference signal through the adaptive finite impulse response (FIR) filter. The control input becomes $$u_k = w_k * x_k \tag{4}$$

-continued $$u_k = \sum_{n=0}^{N} w_n x_{k-n}, \tag{5}$$

where $w_n$ are the coefficients of an $N^{th}$ order FIR filter.

Using equations (4) and (2), the error signal becomes $$e_k = d_k + T_{ce}(k) * w_k * x_k \tag{6}$$

The feed forward controller can only work when the reference signal is coherent to the disturbance signal. In this case, the filter output can be adapted to match the disturbance and the error signal can then be driven toward zero.

In fact, the maximum achievable reduction of the error signal power is related to the coherence between $X_k$ and $d_k$ as $$\text{Maximum Reduction (dB)} = 10\log\left[\frac{1}{1-\gamma_{xd}^2}\right], \tag{7}$$

where $\gamma^2_{xd}$ a is the coherence between the reference signal, $X_k$, and the disturbance signal, $d_k$.

A cost function is defined using the error signal as $$C(W_i) = E[e_k^2] \tag{8}$$

where E[] denotes the expected value operator. With the substitution of equations (5) and (6), equation (8) becomes $$C(w_i) = E\left[\left(d_k + T_{ce}(k) * \left(\sum_{i=0}^{N} w_i x_{k-i}\right)\right)^2\right] \tag{9}$$

The LMS algorithm adapts the coefficients $w_i$ (i=0, 1, . . . , N) to minimize the cost function and, thus, the error signal. The minimization is accomplished with a gradient descent method. Differentiating the cost function in equation (8) with respect to a single weight, $w_i$, produces $$\frac{\partial C}{\partial w_i} = 2E\left[e_k \frac{\partial e_k}{\partial w_i}\right] \tag{10}$$

$$\frac{\partial C}{\partial w_i} = 2E[e_k T_{ce}(k) * x_{k-i}] \tag{11}$$

$$\frac{\partial C}{\partial w_i} \approx 2 e_k \hat{x}_{k-i} \tag{12}$$

The sequence $\hat{X}_k$ is referred to as the filtered-x signal and is generated by filtering the reference signal, $X_k$, by an estimate of the control loop transfer function, $\hat{T}_{ce}(k)$. Obtaining $\hat{T}_{ce}(k)$ is termed the system identification procedure. The FIR coefficient update using the filtered-x approach becomes $$w_i(k+1) = w_i(k) - 2\mu e_k \hat{x}_{k-1}, = 1, \ldots, N, \tag{13}$$

where $\mu$ is the convergence parameter and governs the stability and rate of convergence. The second term of equation (13), $-2\mu e_k X_{-1}$, represents the change in the ith filter coefficient, $\delta w_i$, with each update. The change, $\delta w_i$, becomes smaller as the minimum is approached because the error signal is diminishing. For a constant rate of convergence, $\mu$ should increase as $e_k$ decreases.

For a single input, single output (SISO) controller, a two coefficient (N=2) FIR filter would be needed to control a pure tone.

Figure 4:
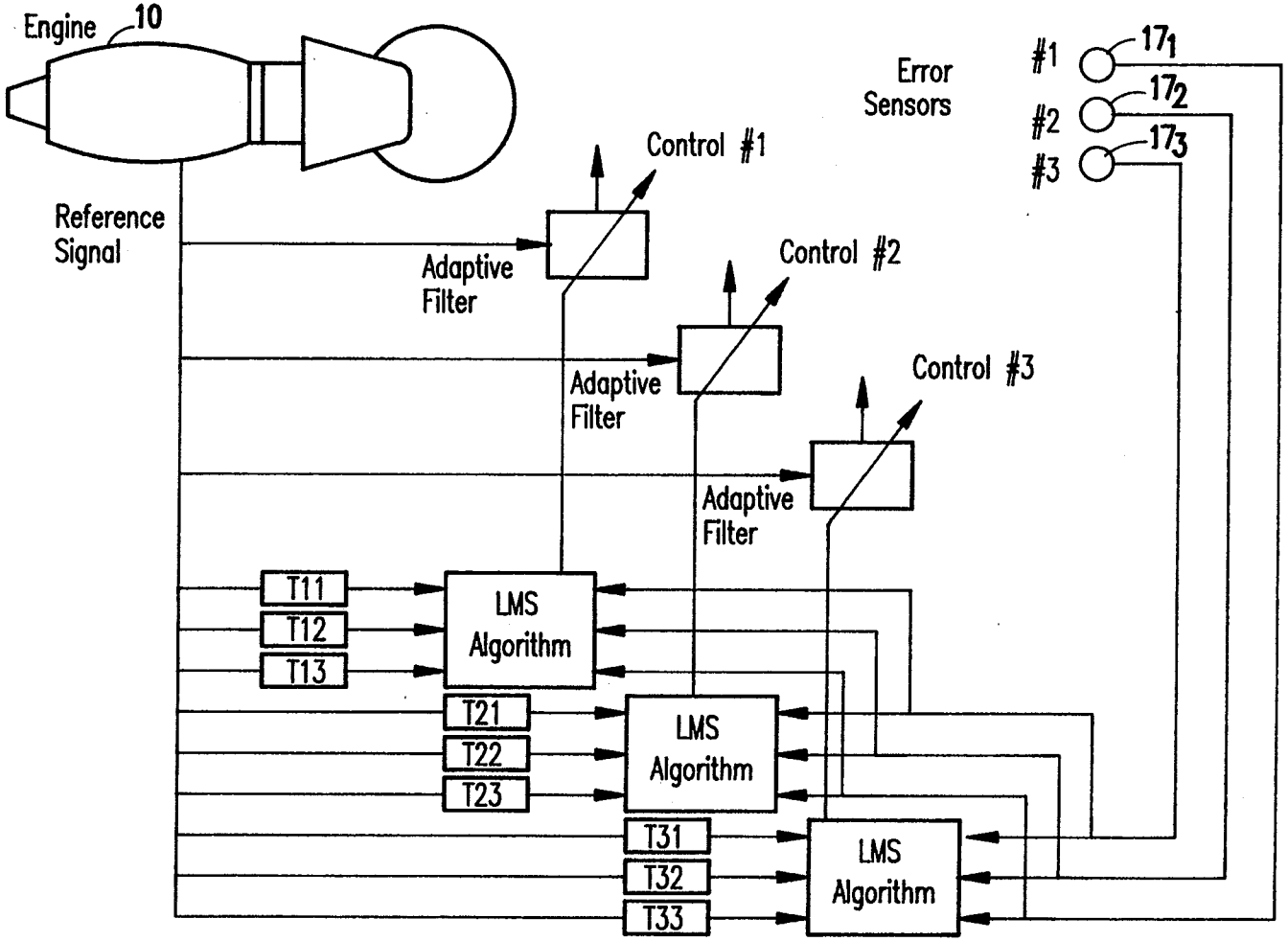
FIG. 4 is a block diagram similar to FIG. 1 showing a three channel control system.

A multiple input, multiple output (MIMO) controller with three channels was developed from the SISO system and is represented in FIG. 4. Only the complexity has increased for the MIMO system as compared to the SISO controller shown in FIG. 1. There are three error sensors $17_1$, $17_2$ and $17_3$ which can be placed in the far field of the sound field. Each control channel controls the drivers attached to four consecutive horns. And there are now nine transfer functions to be measured to form the filtered-x filter. The controller can be extended to as many channels as required for a specific application. This three-channel controller was used to produce the current results.

Figure 5:
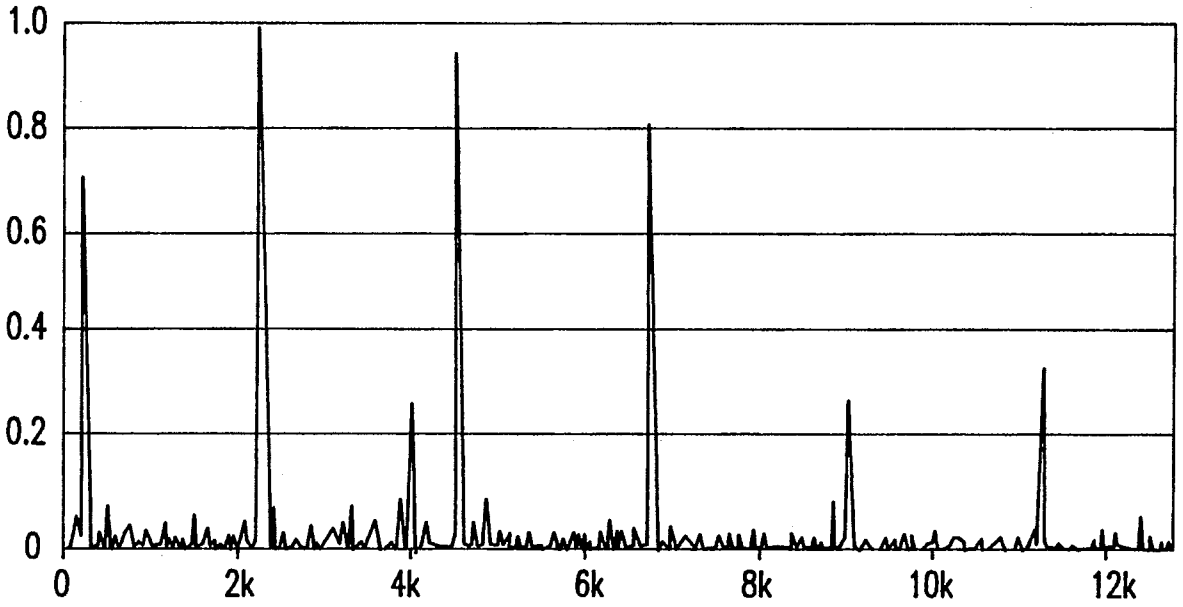
FIG. 5 is a graph showing the coherence measured between blade passage reference sensor and traverse microphone on the engine axis at a distance of 3.0D.

Coherence measured between the fan reference sensor and the far field error microphone is shown in FIG. 5. This shows very high coherence both at the fundamental tone and at the first harmonic which is essential to the feed-forward controller. Coherence between the reference sensor on the high pressure compressor and the far field microphones was found to be similar.

Figure 6:
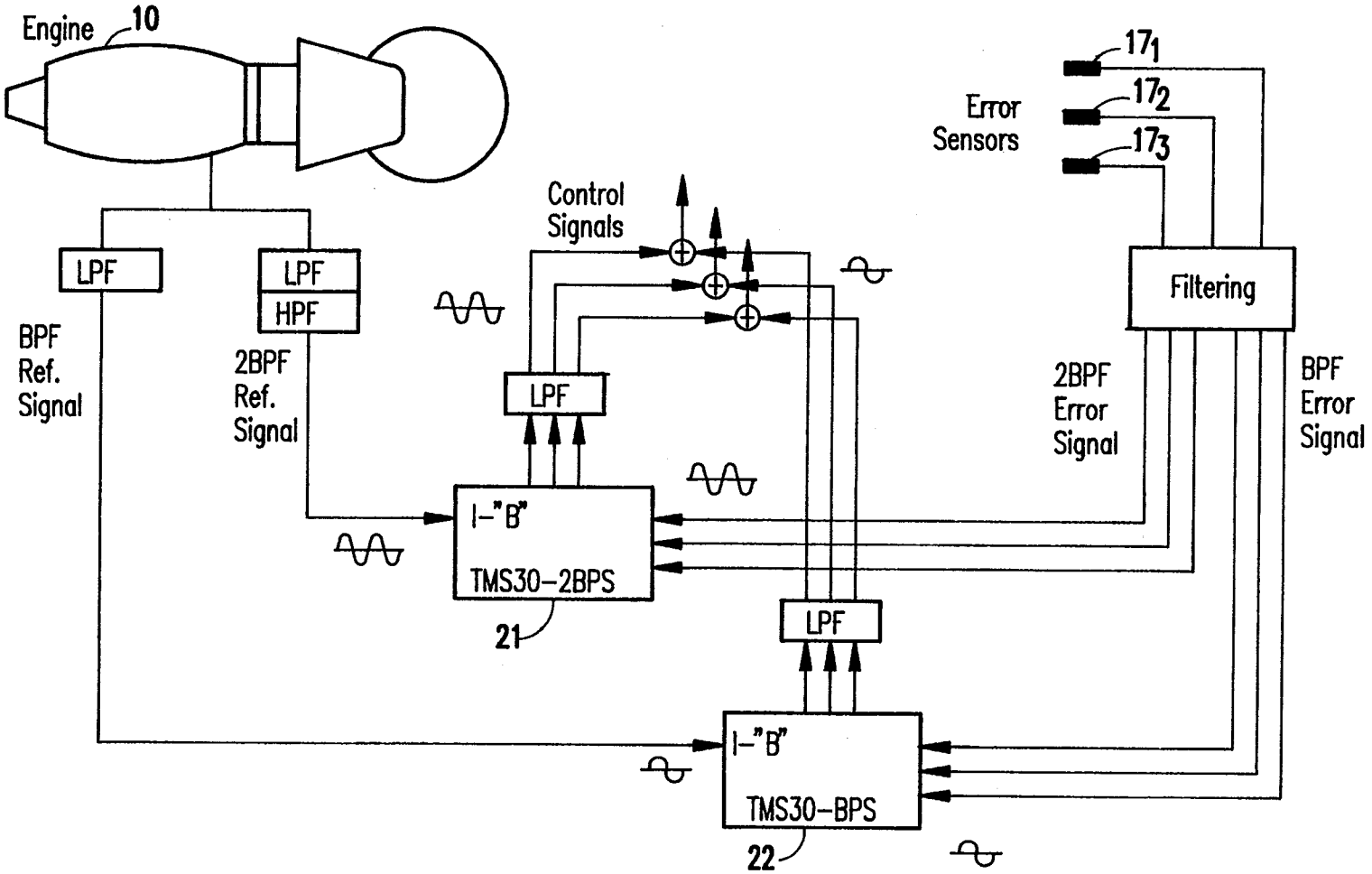
FIG. 6 is a block diagram showing a parallel control configuration using two controllers in a parallel configuration, each a three channel system.

For the control of multiple tones, a controller approach has been developed where multiple controllers work in parallel but are independently dedicated, one controller to each tone. This approach is illustrated in FIG. 6. Each independent controller 21 and 22 is a three channel MIMO controller. Each controller can take reference information and error information from common sensors, appropriately filtered for each controller, or from different sets of sensors. The control output of the controllers is mixed and sent to the common set of control sound sources. This approach allows the sampling frequency of each controller to be optimized and allows flexibility in use of reference and error sensors.

A control experiment is performed in the following order. A system identification is obtained by injecting a tone at a frequency at or near the FBPF tone to be controlled and measuring the transfer functions between each channel of control sound sources and each error microphone. After this system identification is obtained, the controller converges on a solution such that the FBPF tone is reduced at all three error microphones. A microphone is then traversed 180° at a distance of 3.1D to obtain the directivity of the FBPF tone in the horizontal plane of the engine axis. The traverse microphone is calibrated for measurement of absolute sound pressure level. Several experiments were conducted.

CONTROL OF FBPF TONE

The three channel MIMO controller was used to control the radiated sound at the blade passage frequency of the fan, 2368 Hz. Three large area PVDF microphones were used as error microphones and placed at a distance of 6.7D from the inlet lip. At this axial distance the microphones were placed at −12°, 0°, and +12° relative to the engine axis and all three were in the horizontal plane through the engine axis.

Figure 7:
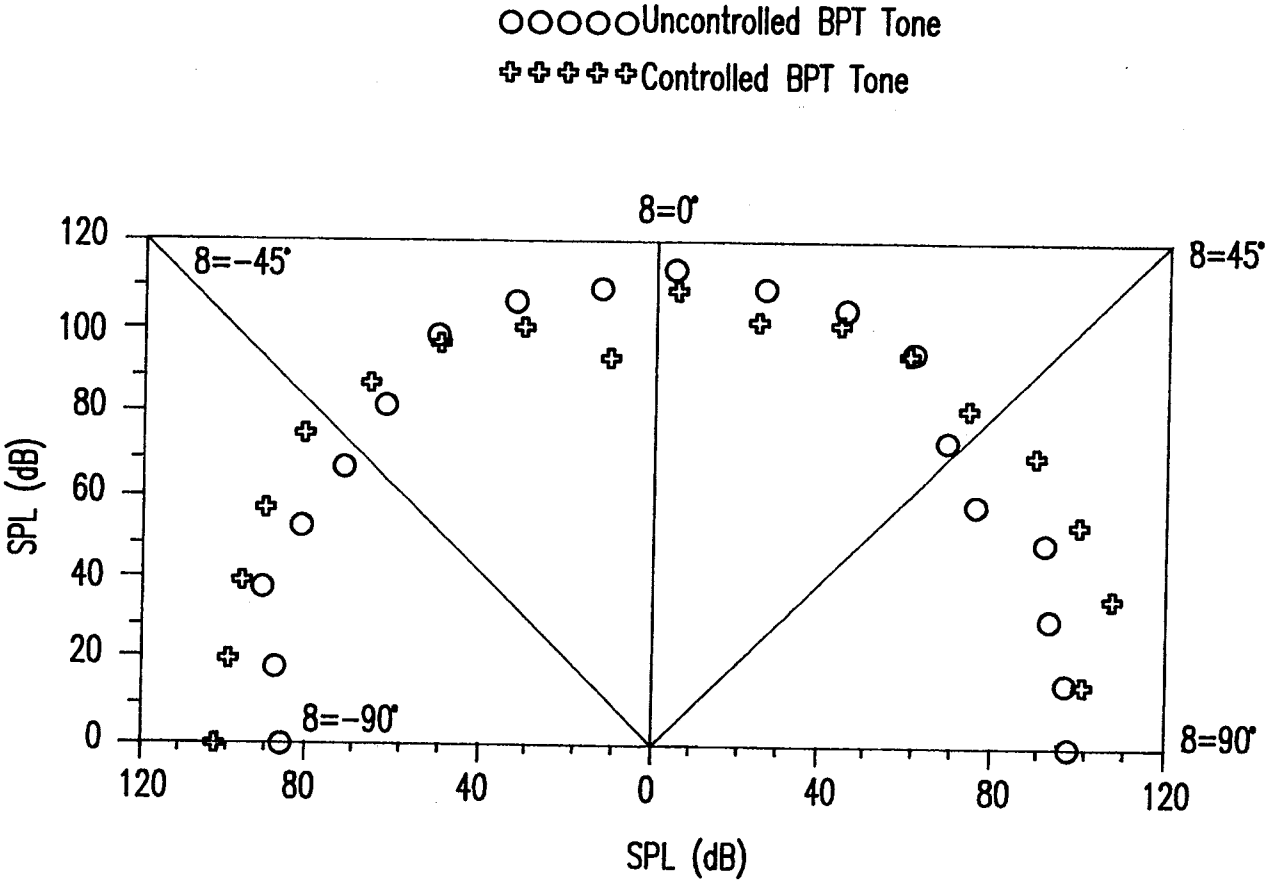
FIG. 7 is a graph showing sound pressure level directivity for the fan blade passage tone, uncontrolled and controlled with the three channel control system.

The traverse microphone signal was fed to a spectrum analyzer where a ten sample average was taken at each location on the traverse. The peak level of the FBPF tone was recorded and the resulting directivity plot is shown in FIG. 7. There is a zone of reduction where the sound pressure levels have been reduced with the controller on over uncontrolled levels. This zone of reduction extends from −30° to +30° with the levels of reduction varying from 1.4 dB at +30° to 16.7 dB at −10°. At angles greater than +30°, toward the sideline regions, the sound pressure levels are higher with the controller as opposed to the uncontrolled levels. The engine noise has a high directivity forward in the angle from −35° to +35°. In other words, the controller has insufficient freedom to beam the control source noise in the forward angle as the engine does without increasing the sideline noise as well. This is expected to improve as the sophistication of the control sources increases either through a higher number of channels or better design and placement of the control drivers themselves.

Figure 8:
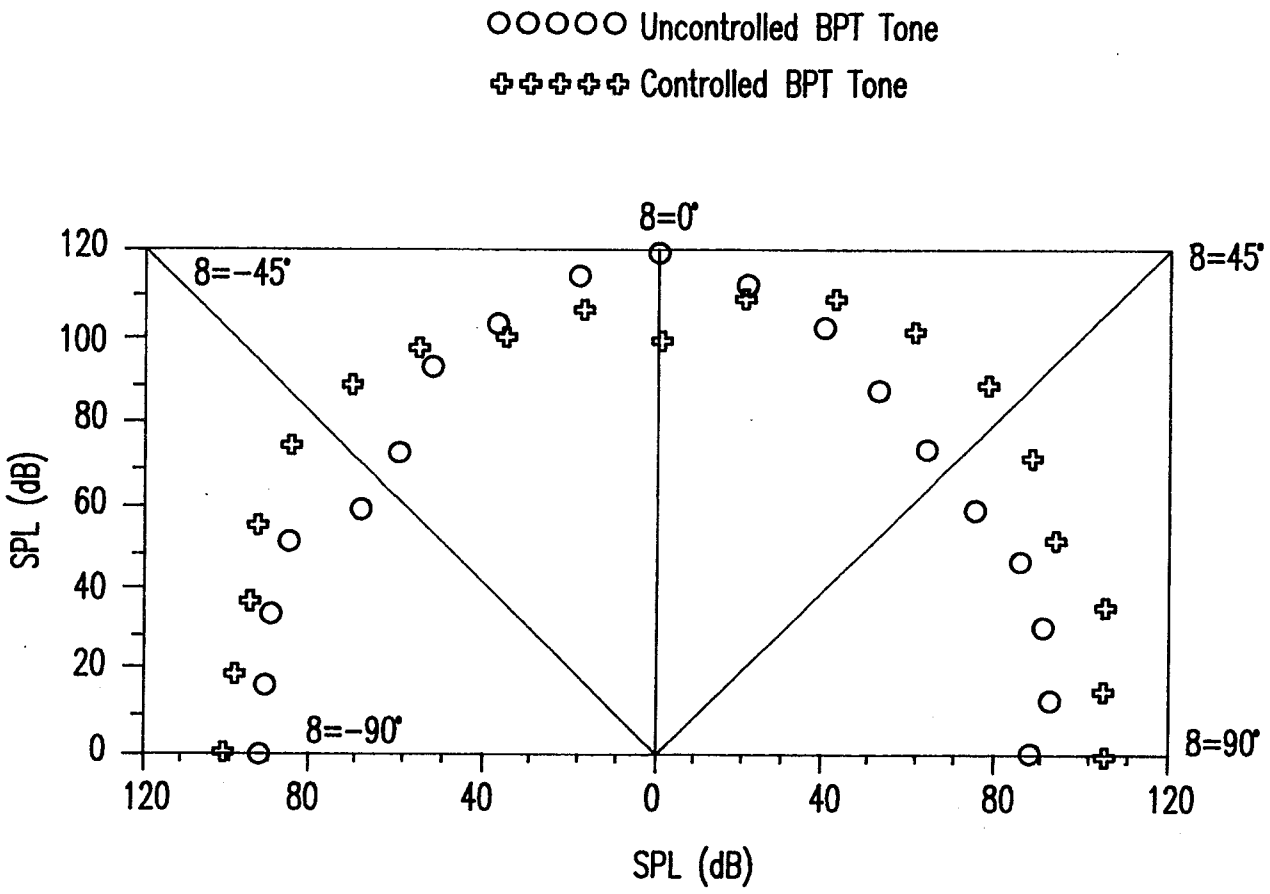
FIG. 8 is a graph showing sound pressure level directivity for the fan blade passage tone, uncontrolled and controlled, with a single channel control system.

FIG. 8 shows the directivity for the sane experiment using a SISO controller with one large area PVDF microphone placed on the axis. The area of reduction extends over a 30° sector from −20° to +10° which is a sector only one-half the 60° sector of sound pressure level reduction for the three channel MIMO controller. Comparing sideline spill over for the MIMO and the SISO controllers it is clear that in going from one to three channels of control has reduced the sideline spill over considerably.

Figure 9A:
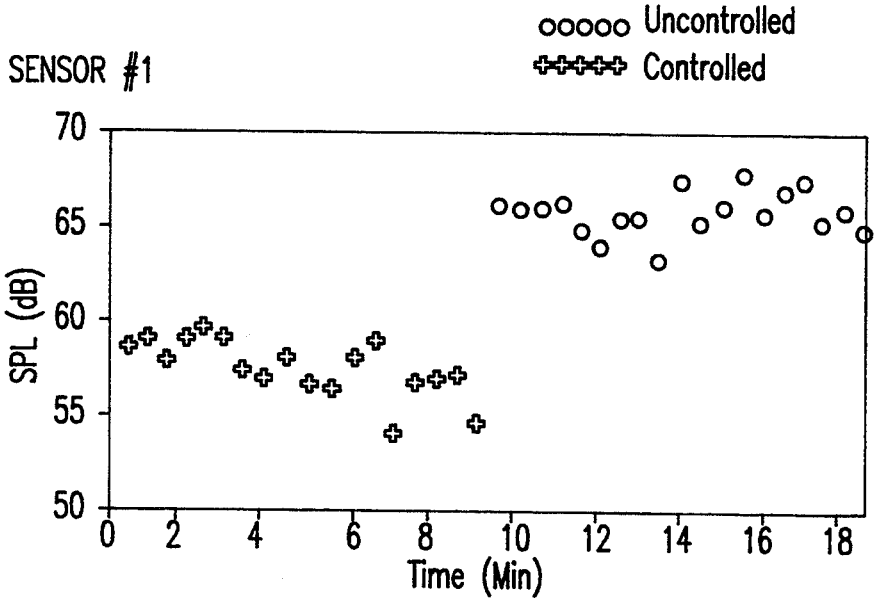
FIGS. 9A, 9B and 9C are graphs showing the time history of error microphones for the three channel control system measuring the peak value of the tone at the blade passage frequency (BPF)
Figure 9B:
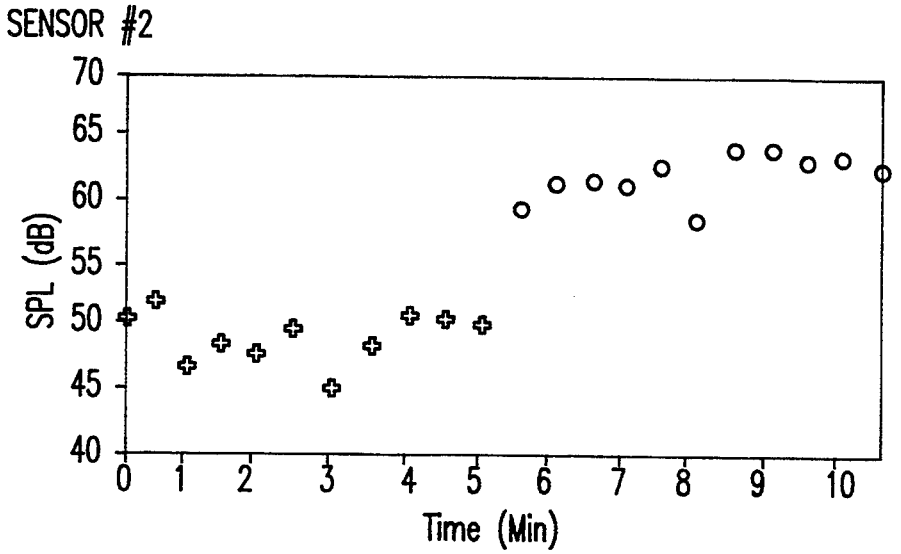
Figure 9C:
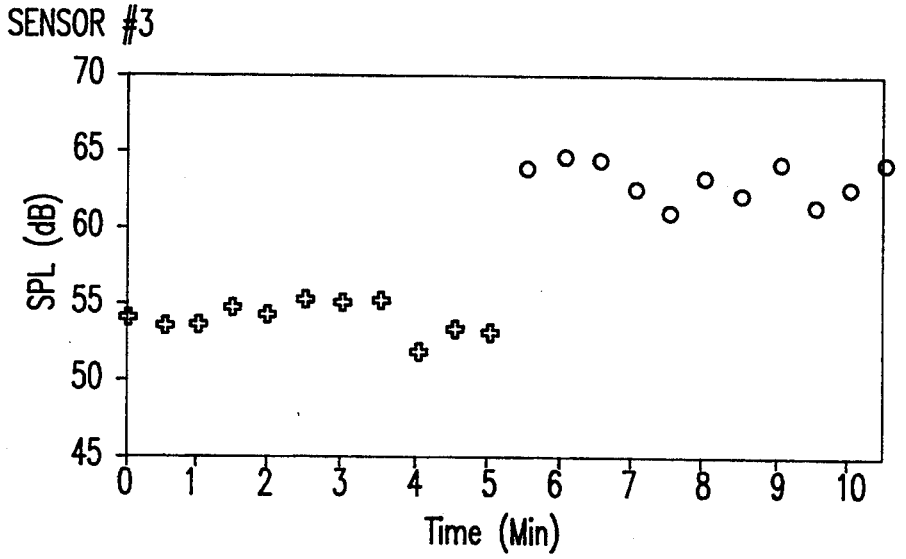

Every time a data point was taken during the survey of the controlled sound field, a reading was taken from error sensor number one which was located near the engine axis. This produced a time history of the error sensor which is shown in FIGS. 9A, 9B and 9C. After nine minutes the controller was turned off and nine minutes of data for the peak level of the uncontrolled FBPF tone was taken. The controller was then turned on again to take five minutes of data each, controlled and uncontrolled, for error sensors numbers two and three. The time histories demonstrate the robustness of the controller to maintain control with time and, once a converged solution has been obtained, the ability to switch on and off the controller to achieve instantaneous control of an engine tone. These factors are valid as long as the system identification is valid. If the system identification were to change the controller would need to have a new system identification and reconverge on the new solution to reestablish control.

Figure 10:
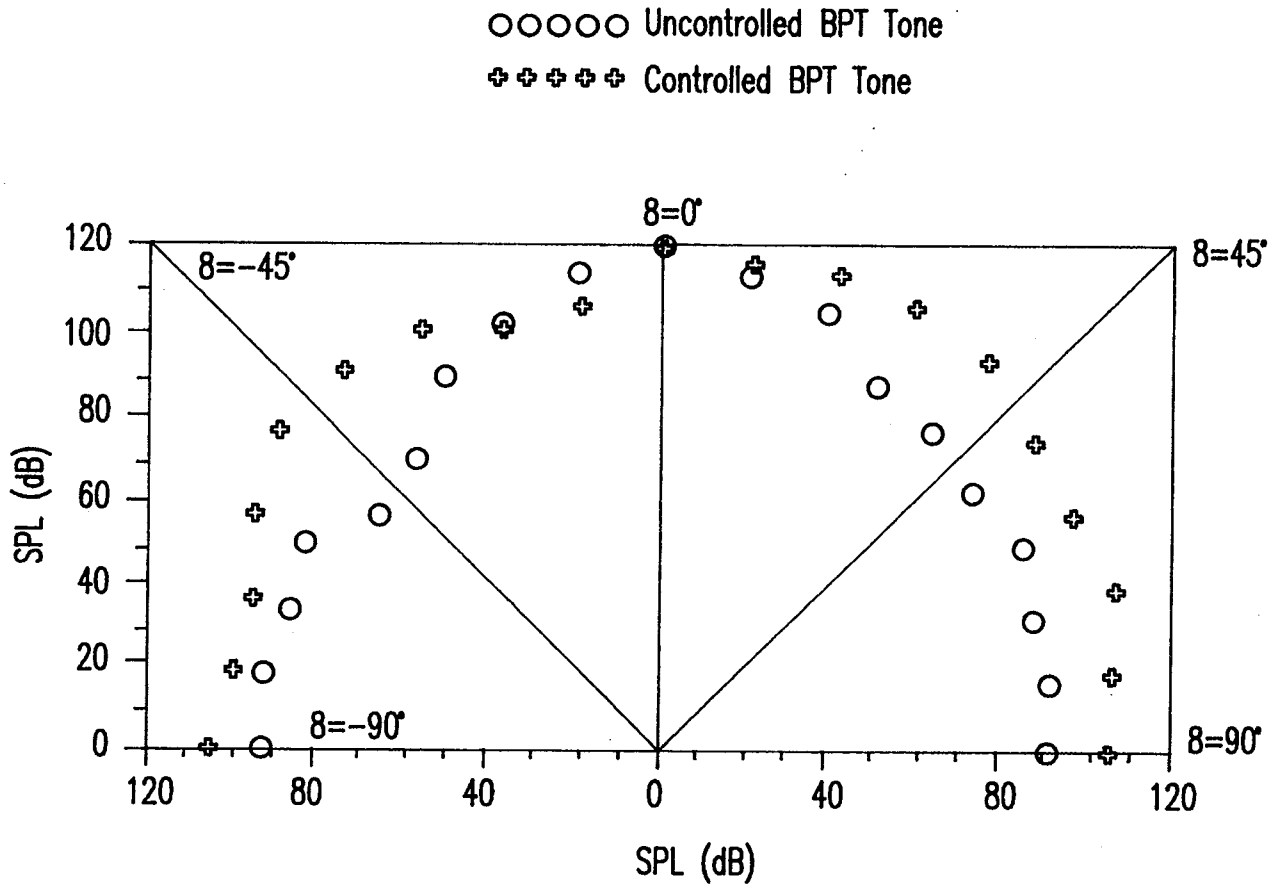
FIG. 10 is a graph showing the pressure level directivity of the fan blade passage tone, uncontrolled and controlled, with a single channel system and a point error microphone.

The large area PVDF microphones were developed for this research because of the inherent unsteadiness in the engine tonal noise directivity. A microphone distributed over a large area would be less sensitive to this unsteadiness than a conventional point microphone of 1.2 cm in diameter, for example. FIG. 10 shows the directivity using a SISO controller and one point error microphone placed at −10°. Comparison with FIG. 8 for a distributed microphone shows a larger area of :reduction for the distributed microphone. A point microphone can only produce localized reduction or notches in the radiated sound. In a specific implementation, the error transducers are installed in the inlet, fuselage or wing depending on the aircraft design.

SIMULTANEOUS CONTROL OF FBPF AND 2FBPF TONES

Directivities of the three major tones in the audible range, FBPF, 2FBPF, and HPBPF show that on the engine axis at 0° FBPF and 2FBPF are the dominate tones. For angles greater than +10° 2FBPF becomes the lesser of the three tones.

Using the parallel MIMO control architecture of FIG. 6, simultaneous control of FBPF and 2FBPF tones was demonstrated. Three PVDF error microphones were placed 6.7D from the engine inlet lip at +10°, 0°, and −10°, all in the horizontal plane.

Figure 11A:
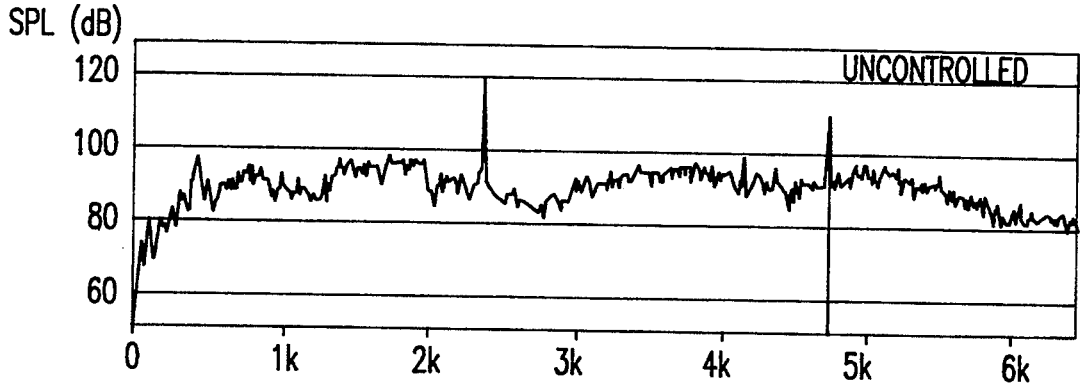
FIGS. 11A and 11B are graphs showing the spectrum of the traverse microphone on the engine axis, uncontrolled and with simultaneous control of the blade passage tone and the first harmonic.
Figure 11B:
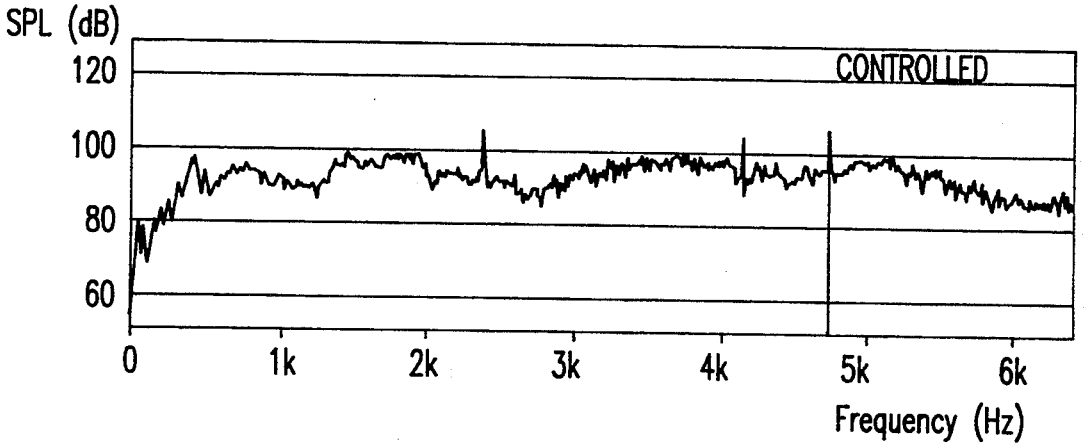

The A-weighted spectrum of the traverse microphone at 0° is shown in FIG. 11A for the uncontrolled case and in FIG. 11B for the controlled ease. The FBPF tone was reduced from 120 dBA to 108 dBA with the controller on. The 2FBPF tone was reduced from 112 dBA to 107 dBA. As noted previously at 0° the HPBPF tone is insignificant.

Figure 12A:
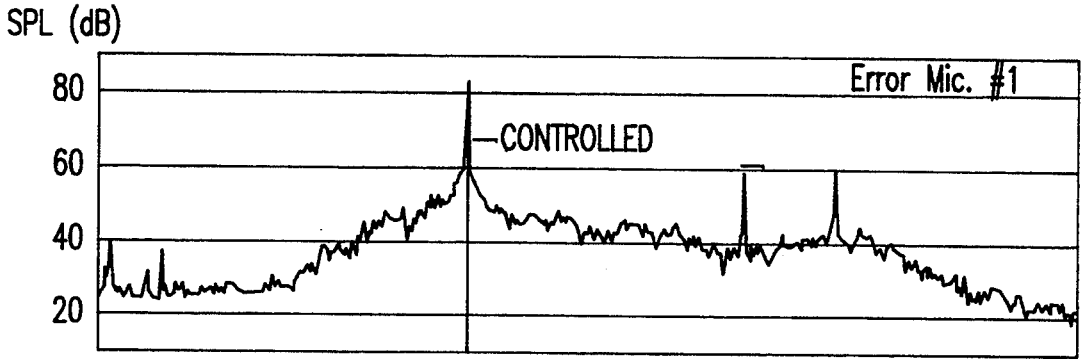
FIGS. 12A, 12B and 12C are graphs showing error microphone spectrums for three channel control system demonstrating simultaneous control of fan blade passage frequency tone and high pressure compressor blade passage frequency tone.
Figure 12B:
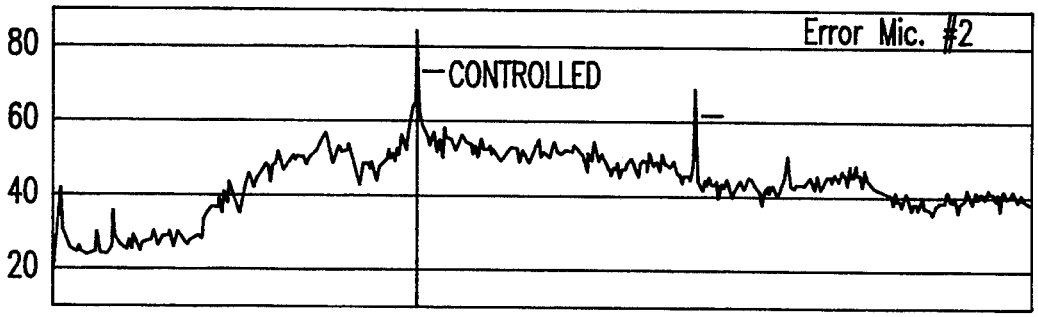
Figure 12C:
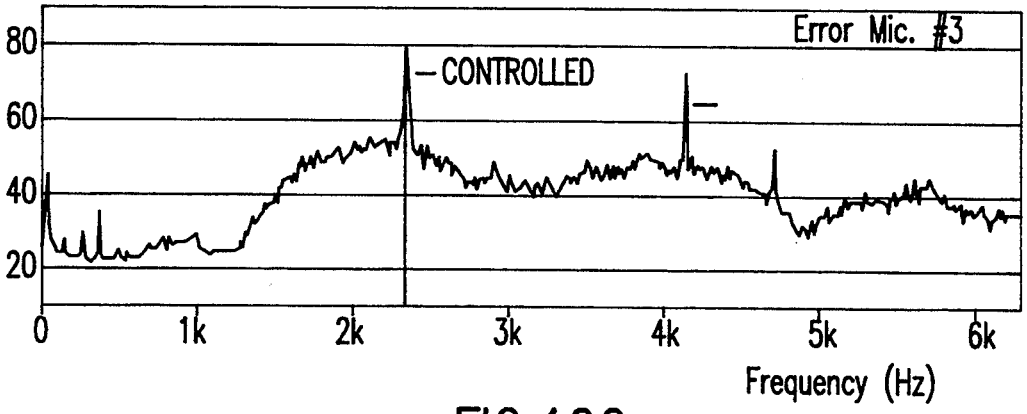

The same control approach was used to control the FBPF tone simultaneously with HPBPF tone. Error microphones were placed in location Similar to the experiment just described. FIGS. 12A, 12B and 12C respectively show the spectrum from the three error microphones. These are filtered for use by the controller which is to control the FBPF at 2400 Hz. Using the parallel control approach, the signal from the error sensors can be filtered different for each controller. For control of the HPBPF tone the signals shown in FIG. 12 would have an additional high pass filter at 3000 Hz. The FBPF tone is controlled at all threw error sensor locations by between 8 dB and 16 dB of reduction. Notice that at error sensor number 1, the HPBPF tone is much lower in level than at the other two locations. Therefore, the controller places less effort in controlling at that point and there is actually a 1 dB increase. At error microphones 2 and 3 the HPBDF tone is reduced by 7 dB and 10 dB, respectively.

Figure 13:
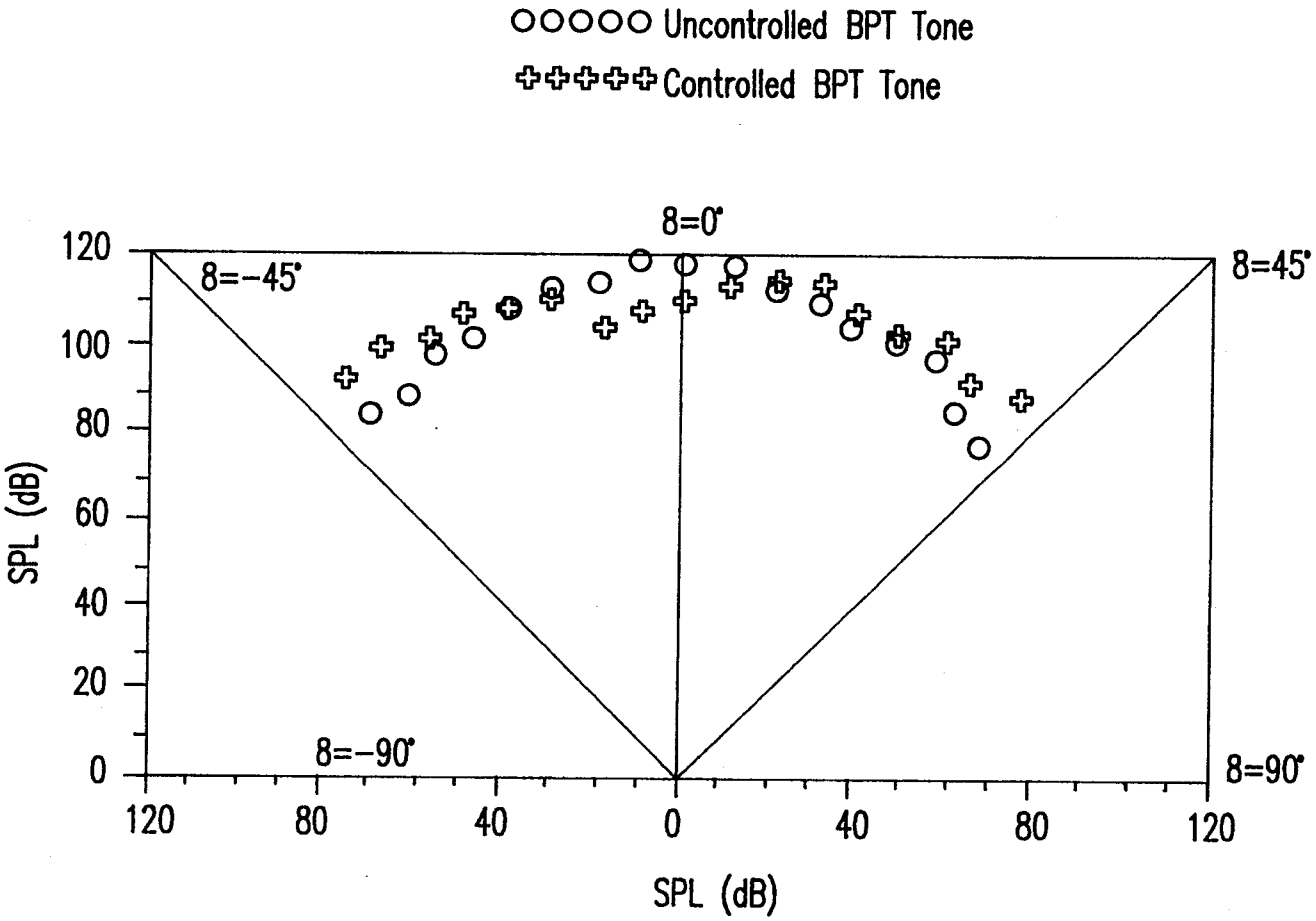
FIG. 13 is a graph showing sound pressure level directivity of FBPF tone, uncontrolled and controlled, for simultaneous control of FBPF and HPBPF tones.
Figure 14:
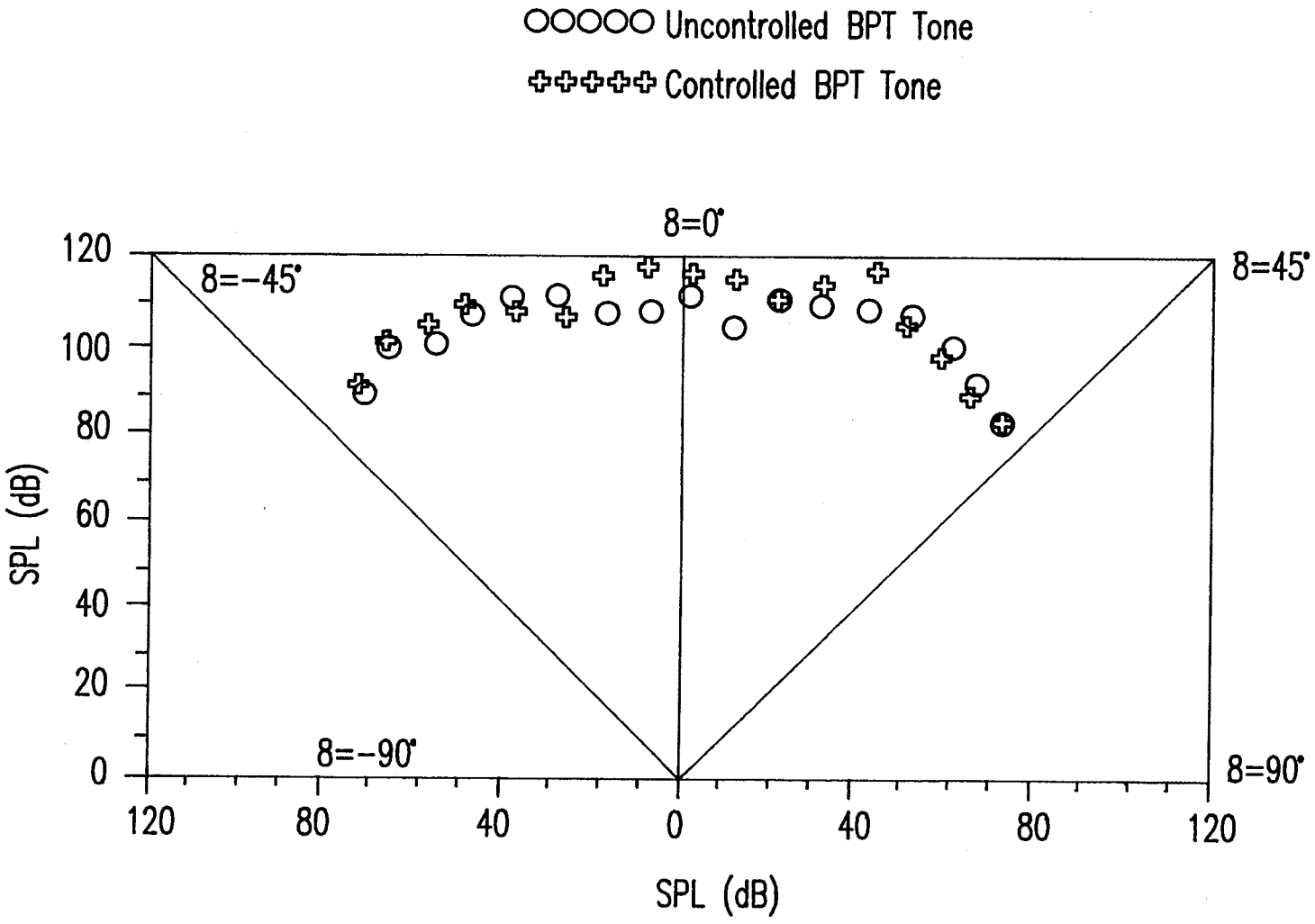
FIG. 14 is a graph showing sound pressure level directivity of HPBPF tone, uncontrolled and controlled, for simultaneous control of FBPF and HPBPF tones.

The traverses of the radiated sound field are shown in FIG. 13, for the FBPF tone, and in FIG. 14, for the HPBPF tone. These data were taken as the two tones were simultaneously controlled. The FBPF traverse shows reduction in a zone from −20° to +5°, not as good a result as when the FBPF tone was controlled singularly. The survey of the HPBPF tone shows two zones of reduction, from −20° to −15° and from −25° to +35°. While the degree of global reduction is not large the sideline increase appears to be small. The control approach can be readily extended to as many tones as required with the parallel control architecture disclosed.

The concept of active control of noise has been shown to be effective by the experimental data for the reduction of turbofan inlet noise. The multi channel control system has demonstrated control of the fan blade passage frequency tone, the first harmonic tone of the fan fundamental, and the blade passage frequency tone of the high pressure compressor. Reductions of up to 16 dB are possible at single points in the far field as well as reductions over extended areas of up to 60° sectors about the engine axis. The sound can also be attenuated to selected directions. For example, the sound can be reduced in directions towards the ground and the fuselage.

Several features of this multi channel control system have been demonstrated. These key features include:

1. The multi channel controller allows the increased flexibility required to increase global reduction.
2. Error microphones which are distributed in nature provide increased local reductions.
3. The parallel controller approach provides the most flexible way of controlling multiple tones.

In the experiments, the loudspeakers used to generate the control field were large, bulky, and thus unsuitable for aeronautical application. In order to make active control of fan noise a viable technology, it is necessary to replace the loudspeakers used with an acoustic source suitable for aeronautical applications. Such a source must be powerful enough to effectively reduce the primary noise field, yet impose no prohibitive penalty in terms of size, weight, or aerodynamic loss. Thus, a compact, lightweight sound source was developed.

Figure 15:
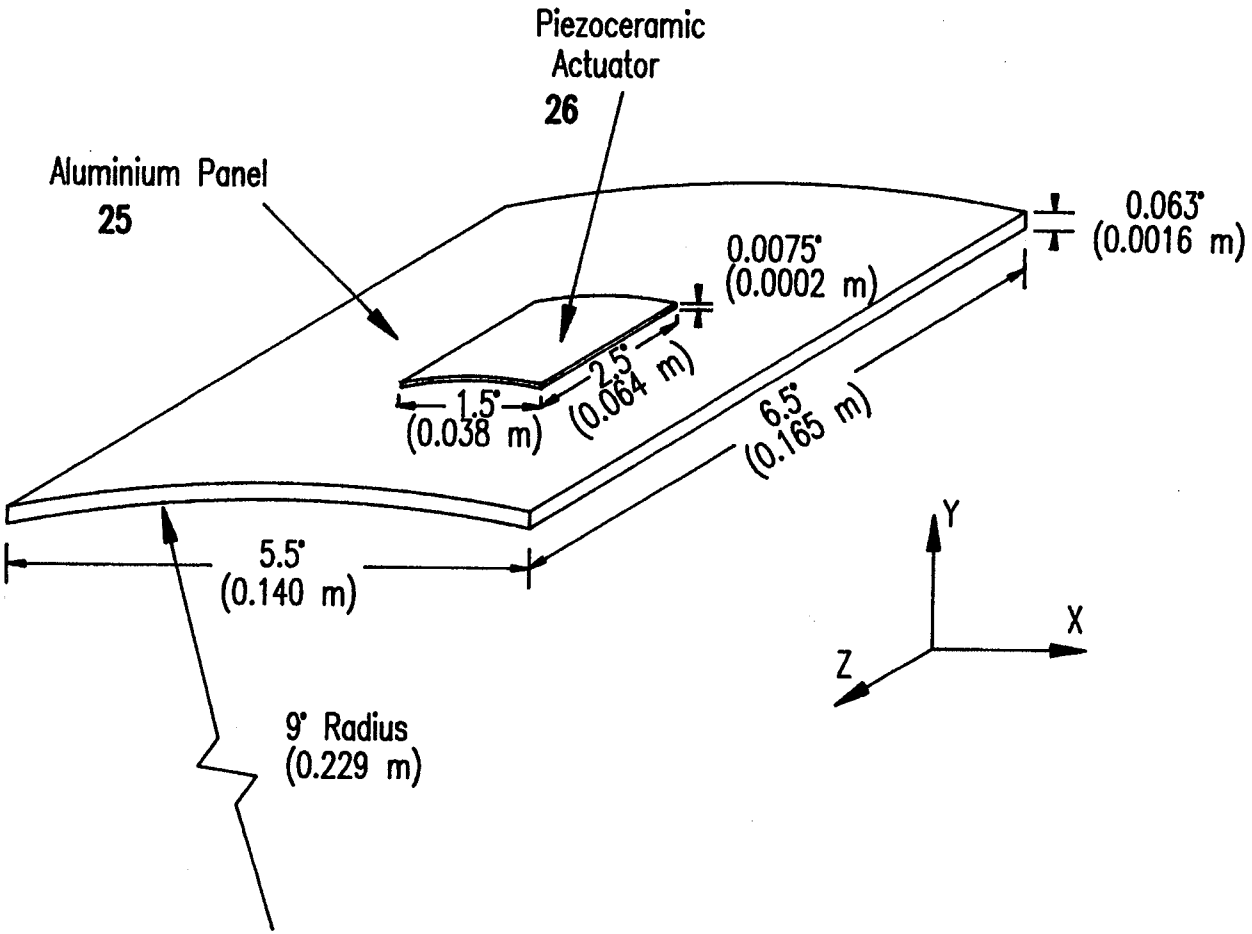
FIG. 15 is an isometric view illustrating the basic design of the compact sound source panel used in a practical application of the invention.

As shown in FIG. 15, the control field sound source is a thin, cylindrically curved panel 25 with one or more induced strain actuators 26, such as piezoelectric force transducers, mounted on the surface of the panel. An array of these curved panels with an inner radius of curvature corresponding to that of the engine inlet are flush mounted inside the inlet duct and sealed on all edges to prevent leakage around the panel and to minimize the aerodynamic losses created by the addition of the panels. Each panel is designed to have a resonance frequency near the tone to be canceled; e.g., the fundamental blade passage frequency, typically 2000–4000 Hz.

Figure 16A:
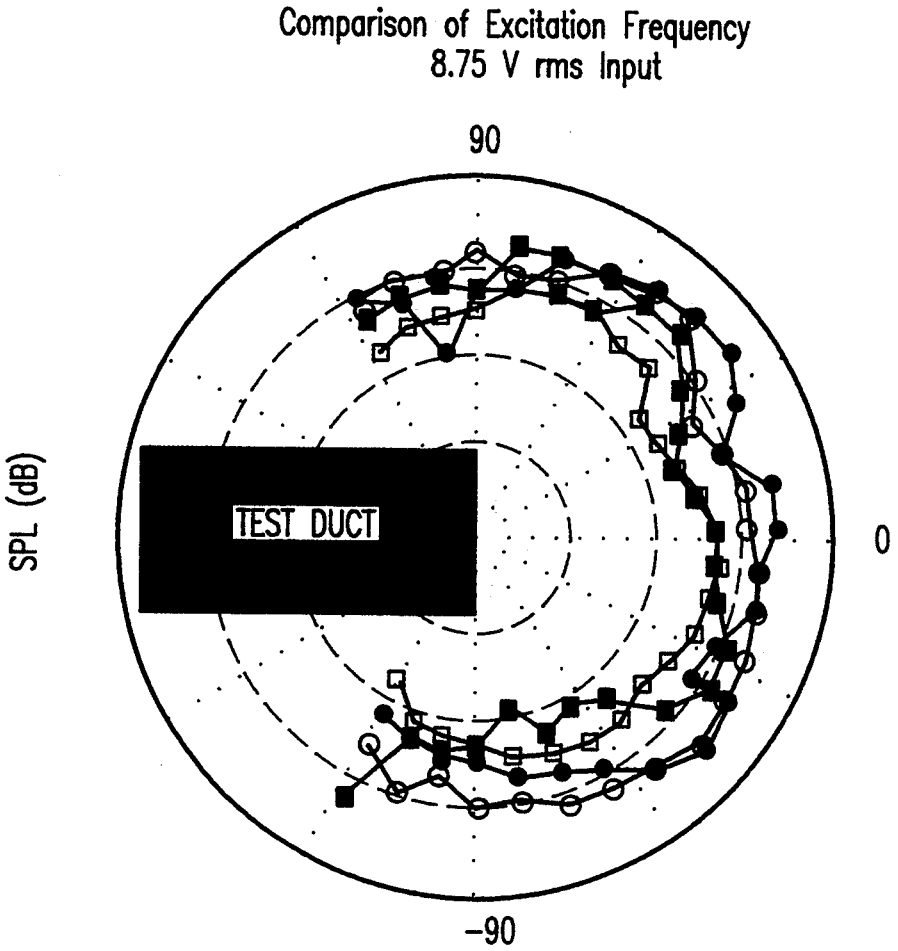
FIG. 16A is a graph showing the radiation directivity of a single panel excited with an oscillatory voltage at 1800 Hz of 8.75 volts rms.
Figure 16B:
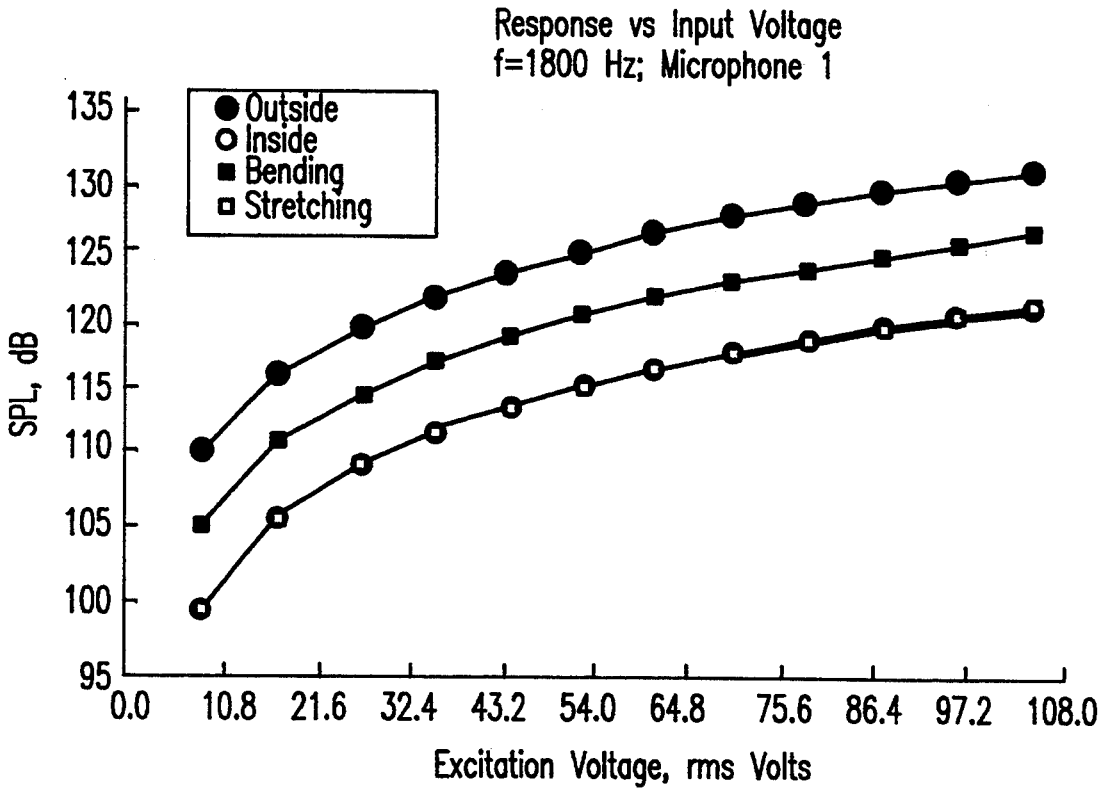
FIG. 16B is a graph showing the sound pressure level as a function of the applied voltage.

The array of panels are driven independently so each panel will have the proper phase and amplitude to produce the overall sound pressure level required for reducing noise in a particular application, as generally shown in FIGS. 16A and 16B. An oscillatory voltage at 1800 Hz of 8.75 volts rms produced a sound level of 130 dB. The maximum number of panels that can be used depends on the physical dimensions of the panel, the circumference and available axial length of the inlet, and the method of securing the panel to the inlet wall.

The panel used in a specific implementation was constructed of 6061 aluminum and measured 6.5″ (0.1651 m) in the axial direction, 5.5″ (0.1397 m) in the circumferential direction, and 0.063″ (0.0016 m) thick, with an inner radius of 9.0″ (0.2286 m) corresponding to the radius of the inlet duct. The active, or unconstrained, area of the panel is 4.0″ (0.1016 m) long axially by 3.0″ (0.0762 m) long circumferentially, leaving a 1.25″ (0.03175 m) wide band around the perimeter of the active area. This band represents the surface area used to secure the panel. The panel has a fundamental frequency of 1708 Hz and is driven by a piezoceramic patch bonded to the outside of the panel's surface, as generally shown in FIG. 15.

Experimental tests have demonstrated that, unlike fiat panel theory where two actuators are symmetrically mounted on opposite sides of the panel, maximum acoustic output is achieved by driving only an outside actuator. This directly contradicts the flat panel analytical models which predict that driving a pair 180° out of phase maximizes acoustic output. Moreover, it was found experimentally that inside and outside piezoactuators on the curved panel produce significantly different levels of acoustic output. This again is a contradiction of the flat panel analytical models. These results are believed to stem from the panel's curvature coupling the in-plane to the out-of-plane motion.

Since the maximum response of the sound radiation of the panel array occurs at the frequency of fundamental resonance of the piezo-panel system, it is desirable to tune the system to track frequency changes as a result of change in engine speeds. This is done by applying a d.c. bias voltage to the piezoceramic elements which produce a static in-plane force to the panel, changing its resonance frequency. Altering the amount of d.c. bias thus "tunes" the panel system due to the change in resonance frequency. This tuning is made to track the engine inlet noise frequency by changing the d.c. bias, and the secondary sound field is generated by applying an oscillating voltage about the d.c. bias voltage.

Figure 17:
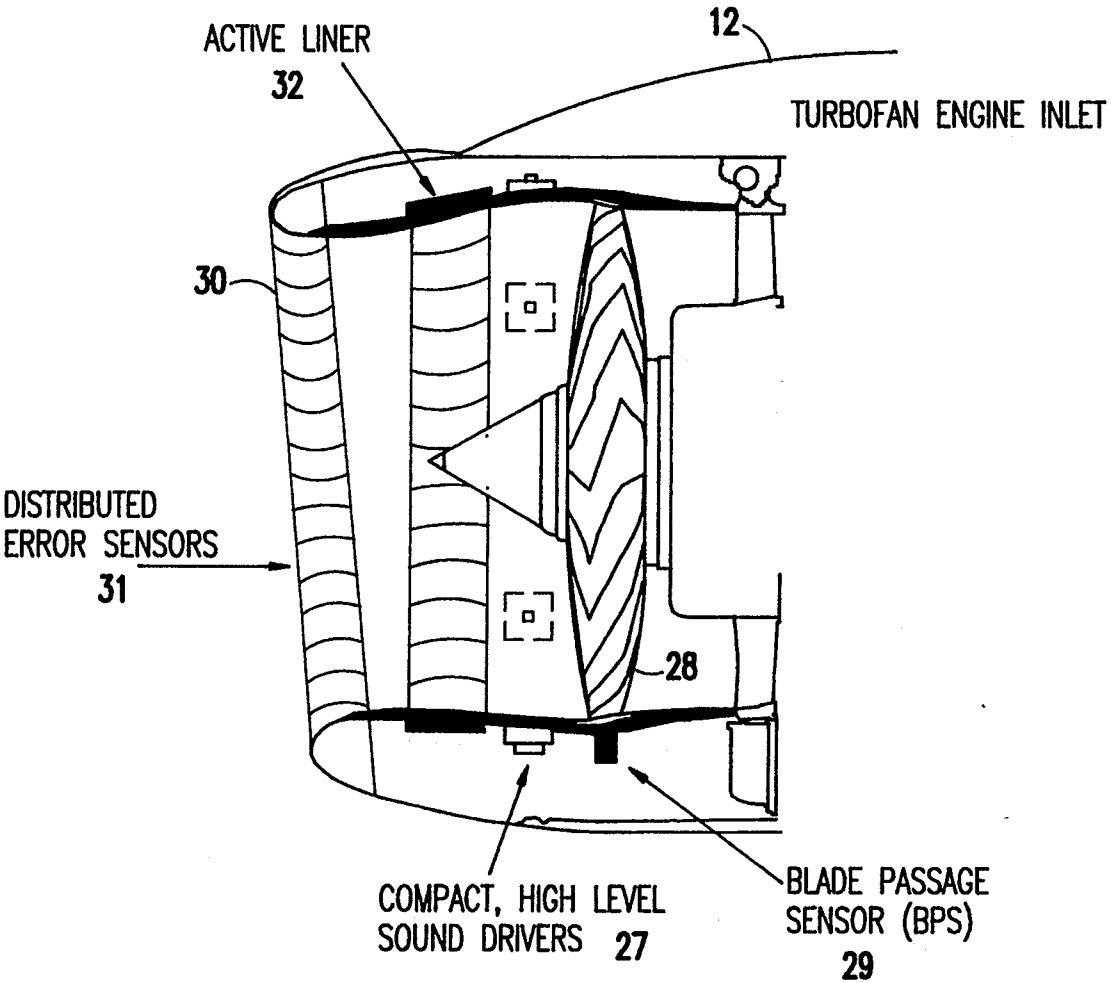
FIG. 17 is a cut-away view of the inlet of an engine showing the locations of the sound drivers and distributed error sensors.

Referring next to FIG. 17, there is shown a cut-away view of an aircraft engine inlet. The high level sound drivers 27 are circumferentially located within the inlet immediately preceding the turbofan 28. Circumferentially adjacent the turbofan 28 are a plurality of blade passage sensors (BPS) 29 which generate the reference acoustic signal. The leading edge 30 of the inlet is provided with a plurality of distributed error sensors 31 embedded therein. The error sensors can be an array of point microphones or distributed strain induced sensors, such as PVDF films. The sensors provide information of the radiated far-field sound. The controller is of the type shown in FIG. 6 wherein several controllers, each dedicated to a specific tone produced by the engine, are used. This parallel controller approach allows the controller to control different engine noise but use the same sensors.

While the invention has been described in terms of a preferred embodiment, those skilled in the art will recognize that the invention can be practiced with modification within the spirit and scope of the appended claims.

Having thus described our invention, what we claim as new and desire to secure by Letters Patent is as follows:

1. An active noise control system for reducing aircraft engine noise which means emanates from an aircraft engine inlet of a gas turbine engine, said gas turbine engine having a fan and compressor the revolution of which generates a primary sound field, said active noise control system comprising:

blade passage sensor means mounted within said turbine engine adjacent to said fan for generating a reference acoustic signal, said blade passage sensor means comprises an eddy current sensor to sense a fan blade passage frequency which is correlated with radiated sound;

distributed error sensor means positioned to be responsive to said primary sound field for generating an error acoustic signal;

acoustic driver means comprised of piezoelectric driven panels mounted circumferentially flush about an interior surface of said inlet preceding said fan; and controller means responsive to said reference acoustic signal and said error acoustic signal for driving said acoustic driver means to generate a secondary sound field having an approximately equal amplitude but opposite phase as said primary sound field to thereby effectively reduce said engine noise.

2. The active noise control system recited in claim 1 wherein said distributed error sensor means comprises a plurality of acoustic sensor devices mounted in said inlet or on a fuselage or wing of an aircraft.

3. The active noise control system recited in claim 1 wherein said controller means comprises:

digital signal processor (DSP) means responsive to said reference acoustic signal and said error acoustic signal for generating a control signal; and adaptive finite impulse response (FIR) filter means connected to receive said reference acoustic signal and responsive to said control signal for generating a driving signal for said acoustic driver means.

4. The active noise control system recited in claim 3 wherein said controller means is a multiple input, multiple output (MIMO) controller wherein said DSP means includes plural DSPs and FIRs connected in parallel to form plural channels.

5. The active noise control system recited in claim 3 wherein said controller means comprises parallel controllers with each controller dedicated to and controlling a different noise frequency, said system further comprising mixing means for combining outputs from each of said controllers to generate driver signals for said acoustic driver means.

6. The active noise control system recited in claim 4 wherein each said controller is a multiple input, multiple output (MIMO) controller wherein said DSP means includes plural DSPs and FIRs connected in parallel to form plural channels.

7. The active noise control system recited in claim 1 wherein said acoustic driver means comprises:

a plurality of said piezoelectric driven panels curved about and conforming to said interior surface, each said curved panels having an interior radius of curvature and an exterior radius of curvature and an exterior surface defined by said exterior radius of curvature; and surface strain piezoelectric actuator means mounted on said exterior surface of each of said curved panels, said surface strain piezoelectric actuator means being driven by said controller means.

8. An active noise control system for reducing aircraft engine noise which emanates from an aircraft engine inlet of a gas turbine engine, said gas turbine engine having a fan and compressor the revolution of which generates a primary sound field, said active noise control system comprising:

blade passage sensor means mounted within said turbine engine adjacent to said fan for generating a reference acoustic signal;

distributed error sensor means positioned to be responsive to said primary sound field for generating an error acoustic signal;

acoustic driver means mounted circumferentially about an interior surface of said inlet preceding said fan; and controller means responsive to said reference acoustic signal and said error acoustic signal for driving said acoustic driver means to generate a secondary sound field having an approximately equal amplitude but opposite phase as said primary sound field to thereby effectively reduce said engine noise, said acoustic driver means comprises:

a plurality of curved panels arranged about and conforming to said interior surface, each said curved panel having an interior radius of curvature and an exterior radius of curvature and an exterior surface defined by said exterior radius of curvature; and surface strain actuator means mounted on said exterior surface of each of said curved panels, said surface strain actuator means being driven by said controller means, said controller means generates a bias voltage to said surface strain actuator means for tuning resonance frequencies of said plurality of curved panels.

9. A compact acoustic driver for generating a controlled sound field for canceling noise comprising:

a curved panel tuned to have a fundamental frequency near a tone in said noise to be canceled, and having an interior radius of curvature and an exterior radius of curvature, said curved panel having an exterior surface defined by said exterior radius of curvature;

surface strain actuator means mounted only on said exterior surface of said curved panel, said surface strain actuator means being mechanically coupled to said curved panel to impart mechanical motion thereto; and electrical generator means connected to said surface strain actuator means for driving said actuator means and imparting mechanical motion to said curved panel at said fundamental frequency to generate said controlled sound field for canceling said tone in said noise.

10. The compact acoustic driver recited in claim 9 wherein said surface strain actuator means comprises at least one piezoelectric force transducer mounted on said exterior surface.

11. A Compact acoustic driver for generating a controlled sound field comprising:

a curved panel having an interior radius of curvature and an exterior radius of curvature, said curved panel having an exterior surface defined by said exterior radius of curvature;

surface strain actuator means mounted on said exterior surface of said curved panel, said surface strain actuator means being mechanically coupled to said curved panel to impart mechanical motion thereto; and electrical generator means connected to said surface strain actuator means for driving said actuator means an imparting mechanical motion to said curved panel to generate said controlled sound field, said electrical generator means drives said actuator means at a frequency approximately equal to a resonance frequency of said curved panel, further comprising means for biasing said actuator means to mechanically stress said curved panel and change the resonance frequency of said curved panel.

12. For use in an active noise control system for reducing aircraft engine noise which emanates from an aircraft engine inlet of a gas turbine engine, said gas turbine engine having a fan and compressor the revolution of which generates a primary sound field, an array of compact acoustic drivers mounted circumferentially about an interior surface of said inlet preceding said fan for generating a controlled sound field, each said compact acoustic driver comprising:

a curved panel tuned to have a fundamental frequency near a tone in said aircraft engine noise to be canceled, and having an interior radius of curvature and an exterior radius of curvature, said curved panel having an exterior surface defined by said exterior radius of curvature;

surface strain actuator means mounted only on said exterior surface of said curved panel, said surface strain actuator means being mechanically coupled to said curved panel to impart mechanical motion thereto; and electrical generator means connected to said surface strain actuator means for driving said actuator means and imparting mechanical motion to said curved panel at said fundamental frequency to generate said controlled sound field for canceling said tone in said aircraft engine noise.

13. For use in an active noise control system for reducing aircraft engine noise which emanates from an aircraft engine inlet from a gas turbine engine, said gas turbine engine having a fan and compressor the revolution of which generates a primary sound field, an array of compact acoustic drivers mounted circumferentially about an interior surface of 8aid inlet preceding said fan for generating a controlled sound field, each said compact acoustic driver comprising:

a curved panel having an interior radius of curvature and an exterior radius of curvature, said curved panel having an exterior surface defined by an exterior radius of curvature;

surface strain actuator means mounted only on said exterior surface of said curved panel, said surface strain actuator means being mechanically coupled to said curved panel to impart mechanical motion thereto; and electrical generator means connected to said surface strain actuator means for driving said actuator means and imparting mechanical motion to the curved panel to generate said controller sound field, said electrical generator means drives the actuator means at a frequency approximately equal to a resonance frequency of said curved panel, further comprising means for biasing said actuator means to mechanically stress said curved panel and change the resonance frequency of said curved panel.

14. The active noise control system as recited in claim 12 wherein said array of compact acoustic drivers comprises a plurality of said curved panels each tuned to a fundamental frequency of said aircraft engine noise to be canceled.

* * * * *